US006830018B2

(12) United States Patent
Sugimoto et al.

(10) Patent No.: US 6,830,018 B2
(45) Date of Patent: Dec. 14, 2004

(54) ENGINE VALVE TRAIN

(75) Inventors: Mitsuru Sugimoto, Saitama (JP); Atsushi Umemoto, Saitama (JP); Norihiko Watanabe, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,780

(22) Filed: Jul. 14, 2003

(65) Prior Publication Data

US 2004/0011310 A1 Jan. 22, 2004

(30) Foreign Application Priority Data

Jul. 16, 2002 (JP) ..... P. 2002-207412

(51) Int. Cl.[7] ..... F01L 9/04

(52) U.S. Cl. ..... 123/90.11; 123/90.16; 123/90.15; 123/90.31; 123/198 F; 251/129.01; 251/129.15; 251/129.16

(58) Field of Search ..... 123/90.11, 90.12, 123/90.15, 90.16, 90.27, 90.31, 193.5, 198 F, 90.39, 90.4, 90.44; 251/129.01, 129.15, 129.16

(56) References Cited

U.S. PATENT DOCUMENTS 4,870,930 A * 10/1989 Yagi ..... 123/90.11
4,934,348 A * 6/1990 Yagi et al. ..... 123/90.16
6,085,704 A * 7/2000 Hara ..... 123/90.11

FOREIGN PATENT DOCUMENTS

JP 63-295812 12/1988

* cited by examiner

*Primary Examiner*—Thomas Demon
*Assistant Examiner*—Kyle M. Riddle
(74) *Attorney, Agent, or Firm*—Armstrong, Kratz, Quintos, Hanson & Brooks, LLP

(57) ABSTRACT

An engine valve train having a camshaft supported on a camshaft holder and driving inlet valves to open and close via inlet rocker arms; an electromagnetic actuator mechanism including an armature; a holding rod connected to the armature and pressing against a stem end of the inlet valve so as to hold the inlet valve in an open state; and, a hydraulic damper mechanism absorbing an impact which is generated by the inlet valve when the inlet valve is released from being held by the electromagnetic actuator mechanism so as to be restored to a closed state and is then seated, wherein the hydraulic damper mechanism is supported on the camshaft holder.

8 Claims, 7 Drawing Sheets

ENGINE VALVE TRAIN

BACKGROUND OF THE INVENTION

1. Field of the Invention

The present invention relates to an engine valve train in which inlet valves are driven to open and close by a camshaft supported on a camshaft holder via inlet rocker arms, in which a stem end of the inlet valve is pressed against by a holding rod connected to an armature of an electromagnetic actuator mechanism so as to hold the inlet valve in an open state, and in which an impact is absorbed by a hydraulic damper mechanism which is generated by the inlet valve when the inlet valve is released from being held by the electromagnetic actuator mechanism so as to be restored to a closed state and is then seated.

2. Description of the Related Art

Among engine valve trains of the aforesaid type, disclosed in JP-A-63-295812 is an engine valve train in which hydraulic damper mechanisms are disposed within an upper space of a valve chamber.

Incidentally, an attempt at using special supporting members to support hydraulic damper mechanisms causes a problem in that the number of components involved is increased. Then, to cope with this problem, an attempt at using a head cover to support the hydraulic damper mechanisms causes problems that the fixing rigidity is deteriorated and that a dimension of an engine in a height direction is increased. In addition, an attempt at using a cylinder head to support the hydraulic damper mechanisms causes problems in that the dimension of the engine in in the height direction is increased and that the working of the cylinder head becomes complicated because of oil passages which communicate with the hydraulic damper mechanisms having to be formed.

SUMMARY OF THE INVENTION

The present invention was made in view of the above situations and an object thereof is to provide a means for supporting the hydraulic damper mechanisms of the engine valve train in a strong and compact manner.

With a view to attaining the object, according to a first aspect of the present invention, there is proposed an engine valve train having: a camshaft supported on a camshaft holder and driving inlet valves to open and close via inlet rocker arms; an electromagnetic actuator mechanism including an armature; a holding rod connected to the armature and pressing against a stem end of the inlet valve so as to hold the inlet valve in an open state; and, a hydraulic damper mechanism absorbing an impact which is generated by the inlet valve when the inlet valve is released from being held by the electromagnetic actuator mechanism so as to be restored to a closed state and is then seated, wherein the hydraulic damper mechanism is supported on the camshaft holder.

According to the construction, the hydraulic damper mechanism is adapted for absorbing the impact generated by the inlet valve, when the inlet valve is released from being held by the electromagnetic actuator mechanism so as to be restored to a closed state and then seated, and is supported on the camshaft holder. Therefore, it is not only the necessity of a special support member obviated to thereby reduce the number of components involved, but also that oil passages which communicate with the hydraulic damper mechanisms can be formed in the camshaft holder to thereby facilitate the working of the cylinder head. In addition, when compared with the case where the hydraulic damper mechanisms are mounted on the head cover, the fixing rigidity can be enhanced, and the dimension of the engine in the height direction can be reduced. Furthermore, when compared with the case where the hydraulic damper mechanisms are mounted on the cylinder head, the cylinder head can be made smaller in size.

According to a second aspect of the present invention, there is proposed an engine valve train as set forth in the first aspect of the present invention, wherein the camshaft holder is an integrated body connected together in a direction in which a plurality of cylinders are arranged, and wherein the hydraulic damper mechanism is provided at a connecting portion of the camshaft holder.

According to the construction, since the hydraulic damper mechanism is provided at the connecting portion of the integrated camshaft holder which is connected together in the direction in which the plurality of cylinders are arranged, the hydraulic damper mechanism is allowed to be mounted on the portion of the camshaft holder which has a high rigidity to thereby enhance the fixing rigidity.

According to a third aspect of the present invention, there is proposed an engine valve train as set forth in the first or second aspect of the present invention, wherein the hydraulic damper mechanism is provided coaxially with and below the electromagnetic actuator mechanism, and wherein the hydraulic damper mechanism is accommodated in the interior of the camshaft holder.

According to the construction, since the hydraulic damper mechanism is accommodated in the interior of the camshaft holder in such a manner as to be situated below the electromagnetic actuator mechanism, not only the dimension of the engine in the height direction can be reduced, but also the fixing rigidity of the hydraulic damper mechanism can be enhanced further.

According to a fourth aspect of the present invention, there is proposed an engine valve train as set forth in the third aspect of the present invention, wherein the hydraulic damper mechanism is provided with a holding rod passage hole through which the holding rod of the electromagnetic actuator mechanism is allowed to pass, the holding rod passage hole also functioning as a vent hole for venting air from an oil chamber of the hydraulic damper mechanism.

According to the construction, since the holding rod passage hole which is provided in the hydraulic damper mechanism so as to allow the holding rod of the electromagnetic actuator mechanism to pass therethrough functions as a vent hole for venting air from the oil chamber of the hydraulic damper mechanism, air in the oil chamber can be vented without providing any special vent hole for that purpose.

According to a fifth aspect of the present invention, there is proposed an engine valve train as set forth in the first aspect of the present invention, further having: a pair of armature fixing mechanisms disposed in the interior of the camshaft holder so as to hold the hydraulic damper mechanism.

According to a sixth aspect of the present invention, there is proposed an engine valve train as set forth in the fifth aspect of the present invention, wherein each armature fixing mechanism includes a cylinder formed in the camshaft holder, a piston which slidably fits in the cylinder, a return spring for biasing the piston upwardly, an oil chamber formed in an upper surface of the piston and an armature locking member which protrudes upwardly from the upper surface of the piston for abutment with a lower surface of a projection from the armature.

Note that first and second inlet rocker arms 30, 31 correspond to the rocker arms of the present invention.

DETAILED DESCRIPTION OF THE PREFERRED EMBODIMENTS

A mode for carrying out the present invention will be described below based on an embodiment of the present invention which is illustrated in the accompanying drawings.

Figure 1:
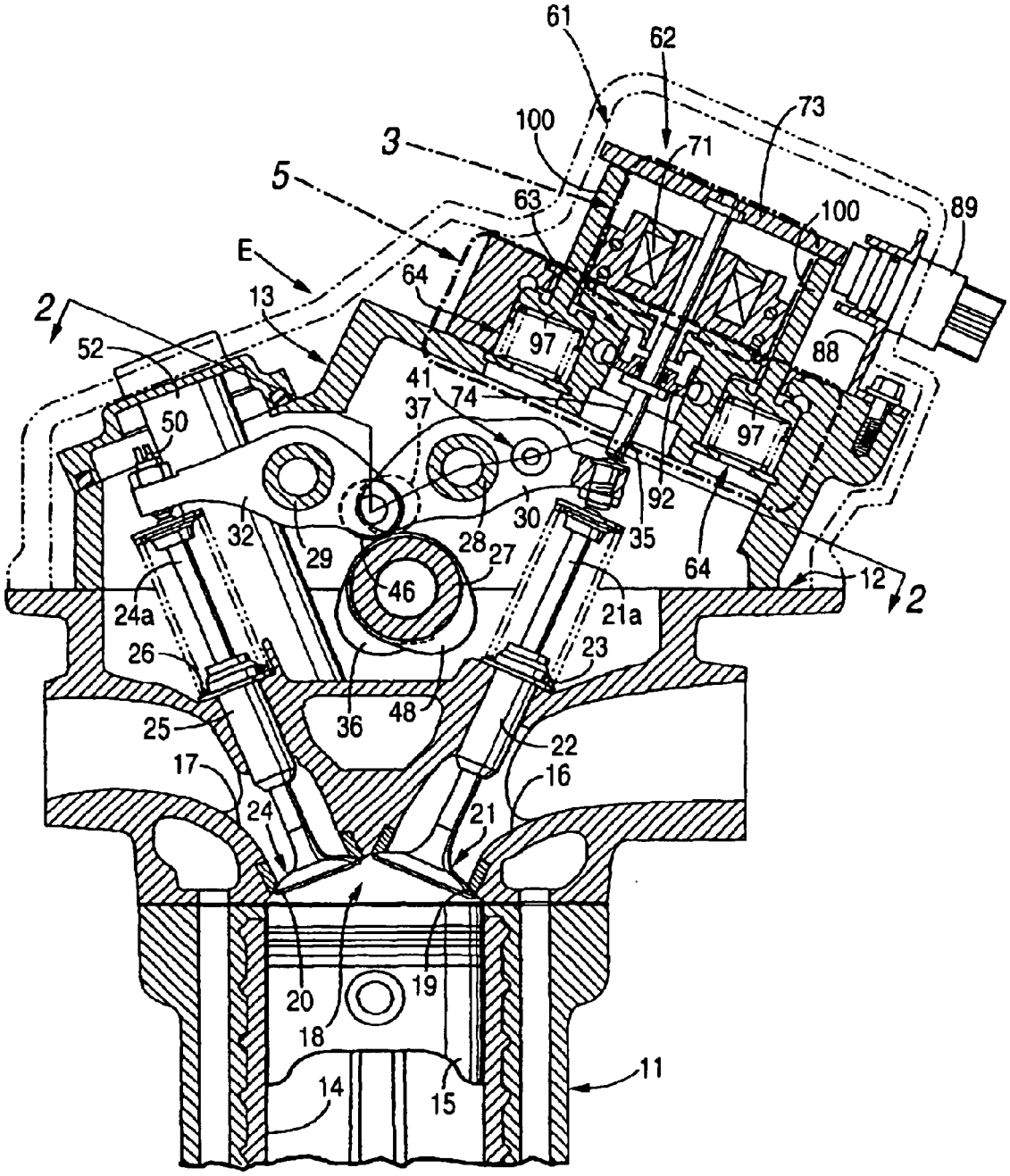
FIG. 1 is a cross-sectional view of a cylinder head of an engine (a cross-sectional view taken along the line 1—1 in FIG. 2)
Figure 2:
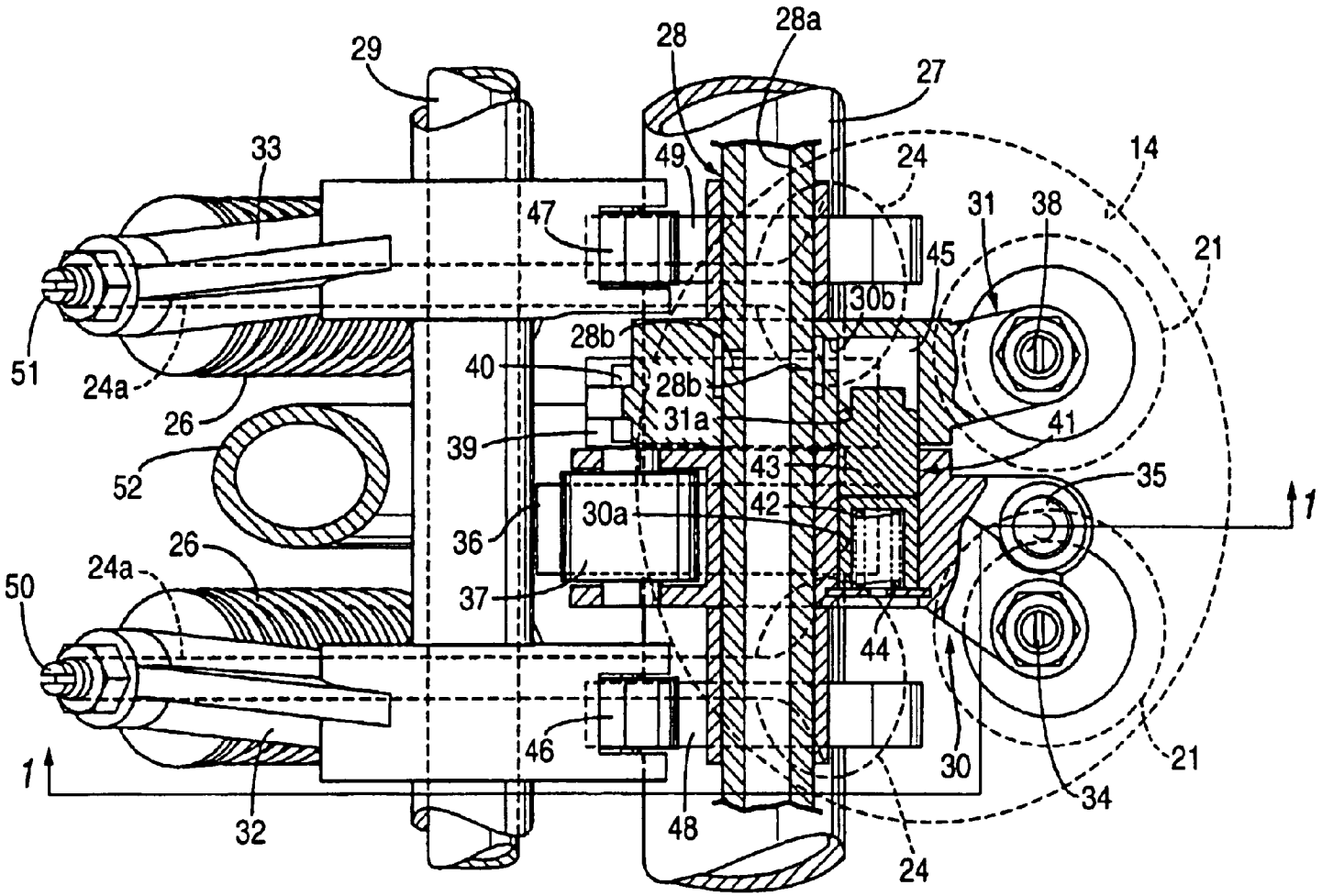
FIG. 2 is a cross-sectional view taken along the line 2—2 in FIG. 1.
Figure 3:
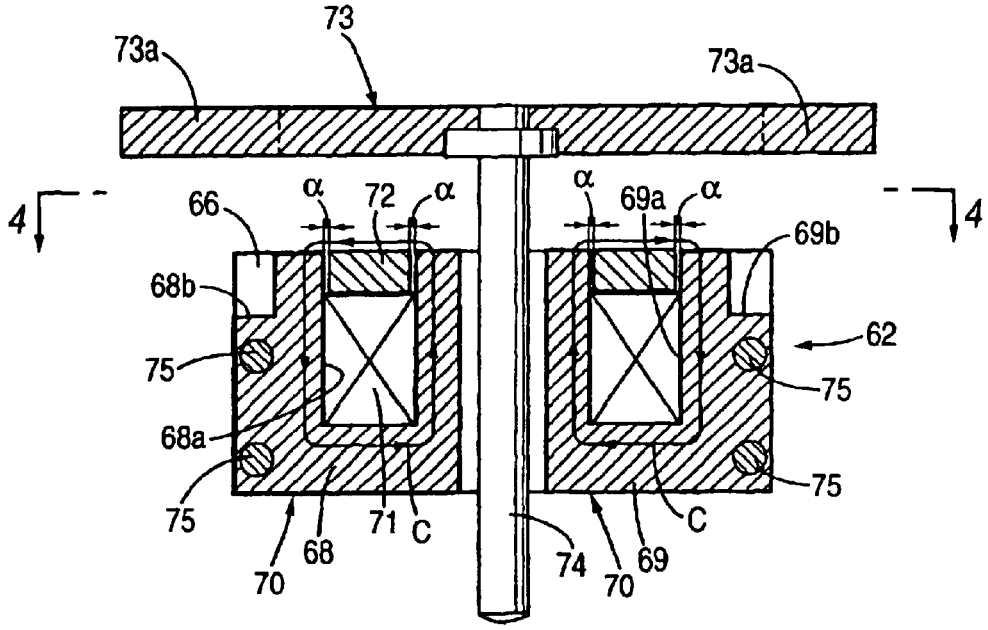
FIG. 3 is an enlarged view of a portion indicated by reference numeral 3 in FIG. 1.
Figure 4:
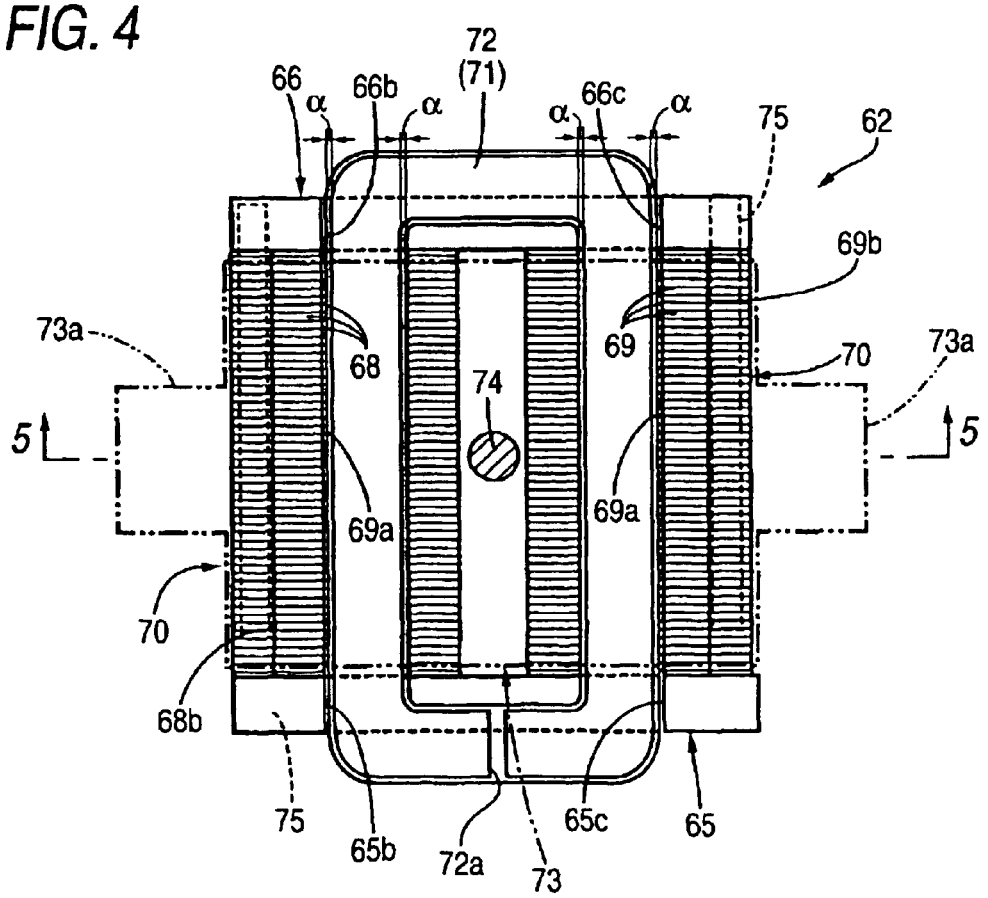
FIG. 4 is a cross-sectional view taken along the line 4—4 in FIG. 3.
Figure 5:
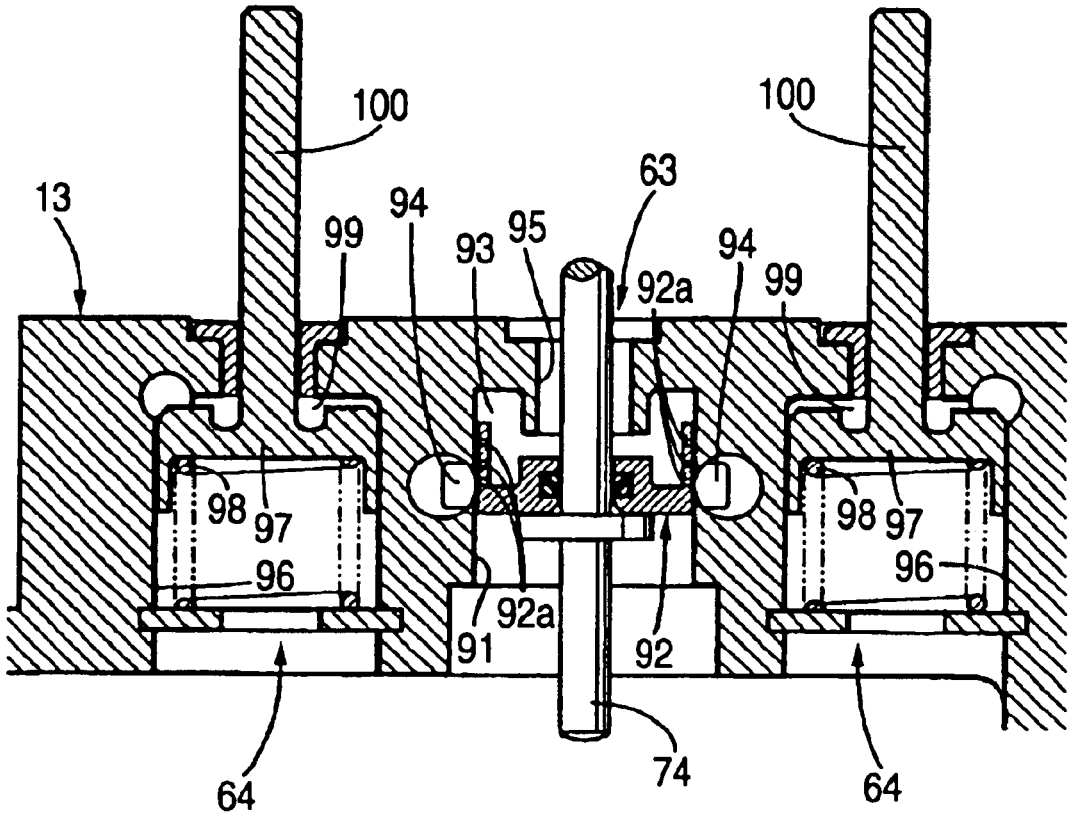
FIG. 5 is an enlarged view of a portion indicated by reference numeral 5 in FIG. 1.
Figure 6:
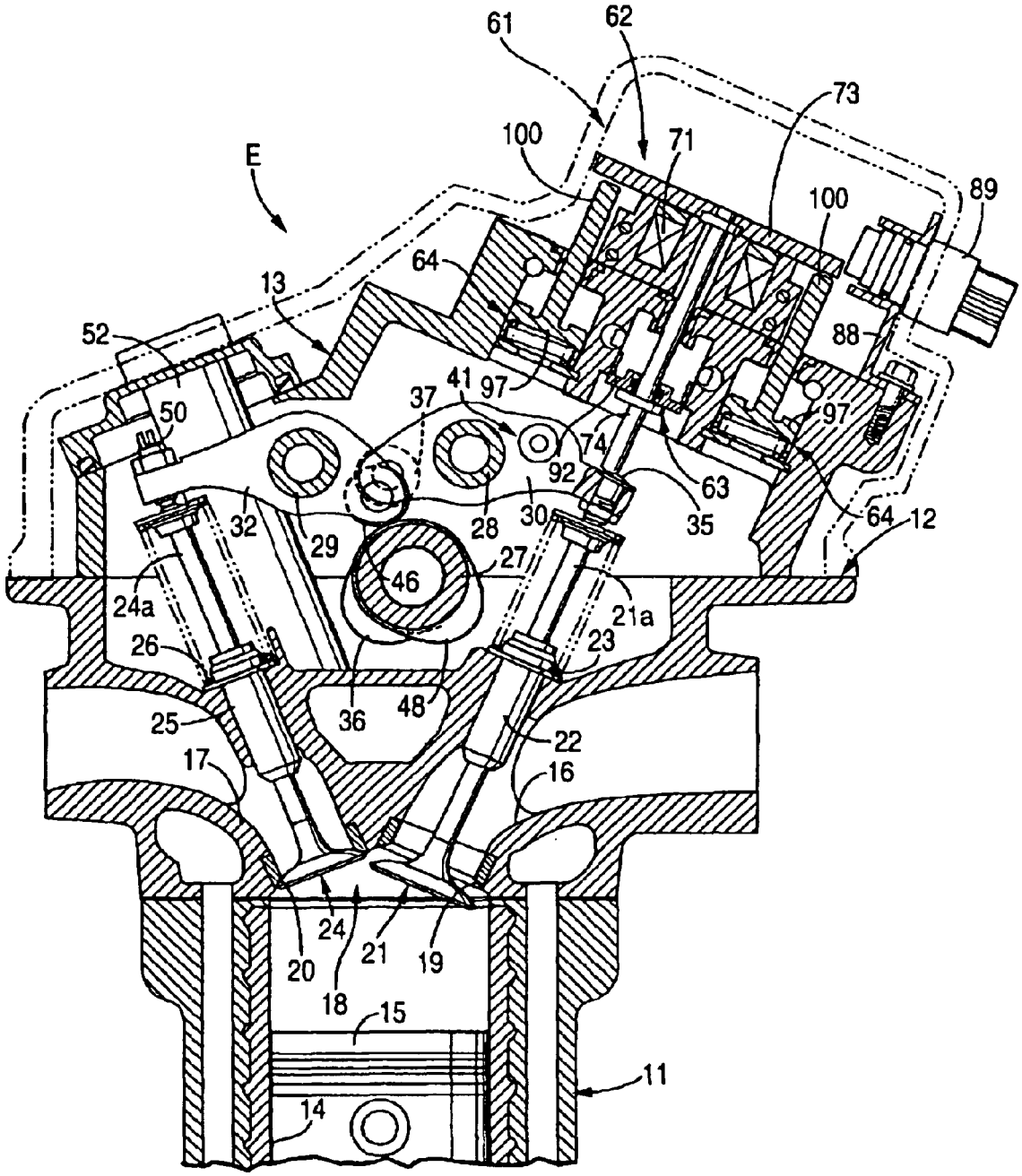
FIG. 6 is a drawing corresponding to FIG. 1, which shows an operating state of an inlet valve closing timing delaying device.
Figure 7:
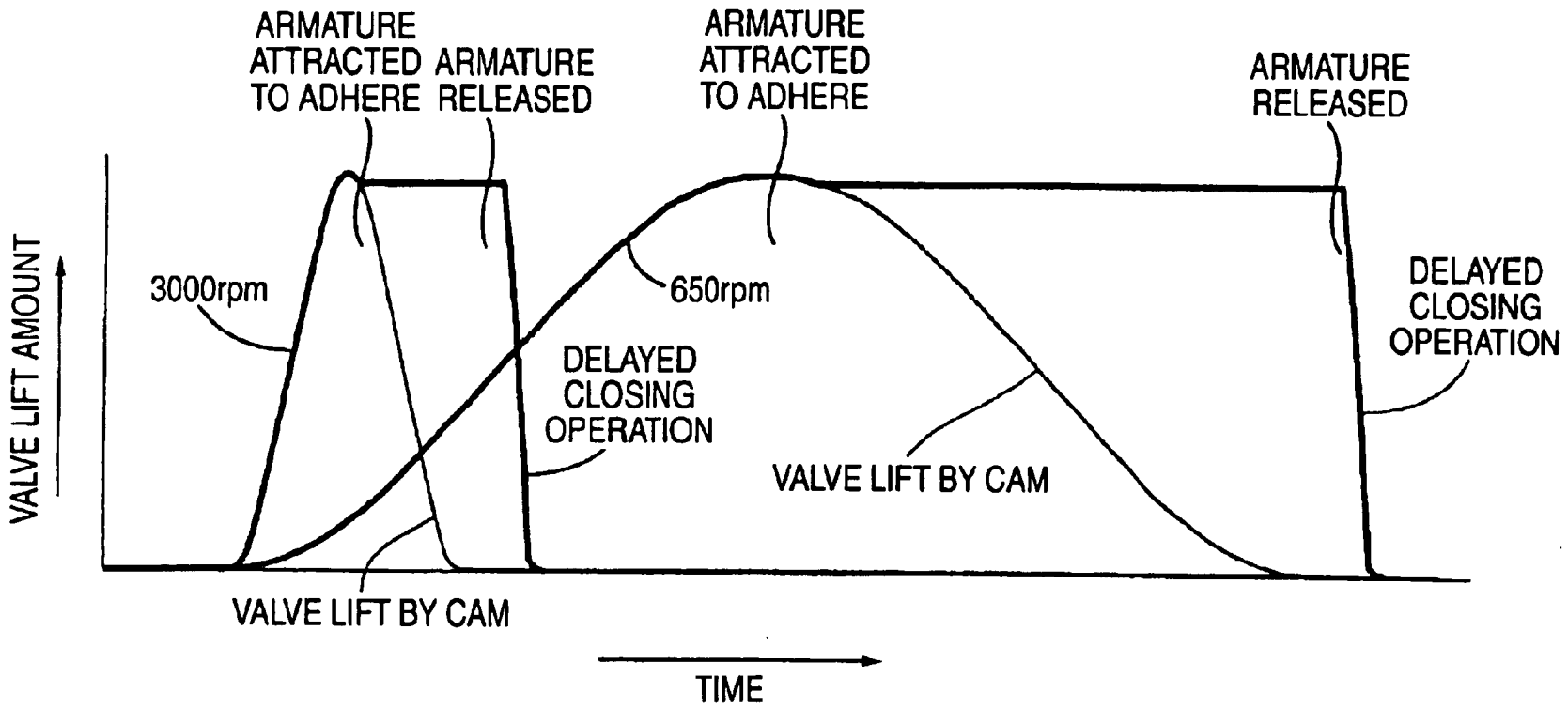
FIG. 7 is a graph showing changes in valve lift amount caused by inlet valve delayed closing control; and, FIGS. 8A and 8B are time charts showing changes in valve lift amount, coil voltage and oil current which occur when the inlet valve delayed closing control is carried out.
Figure 8A:
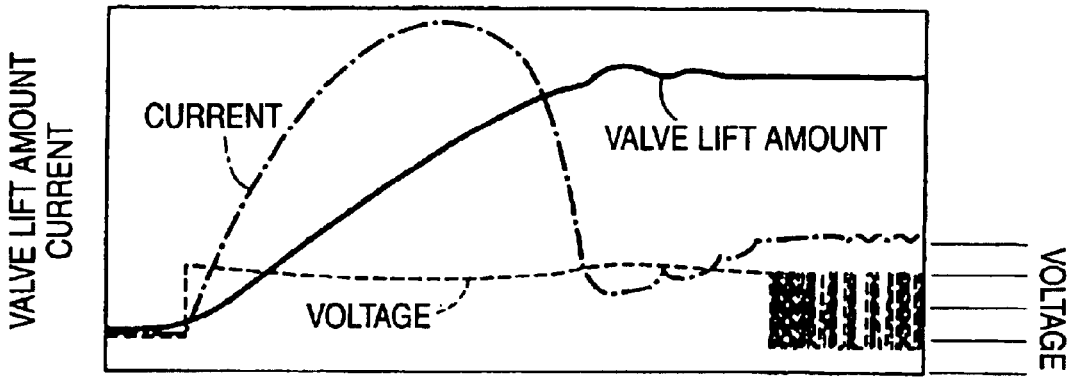
Figure 8B:
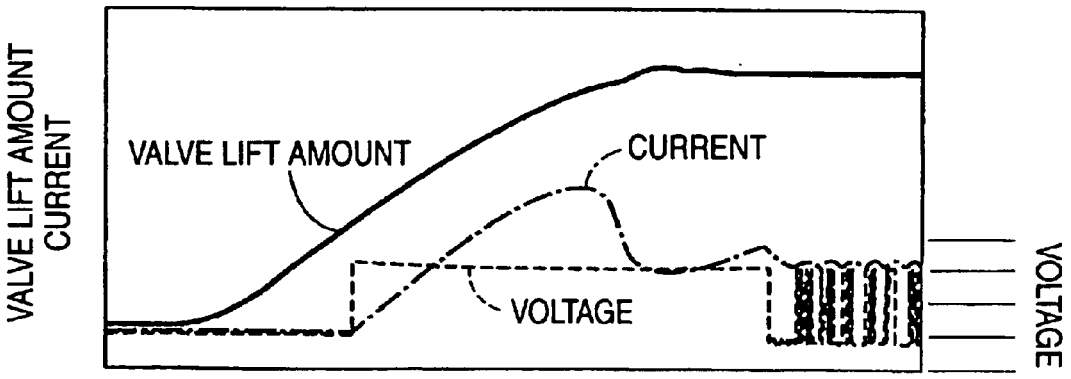

FIGS. 1 to 8 all show an embodiment of the present invention, in which FIG. 1 is a cross-sectional view of a cylinder head of an engine (a cross-sectional view taken along the line 1—1 in FIG. 2), FIG. 2 is a cross-sectional view taken along the line 2—2 in FIG. 1, FIG. 3 is an enlarged view of a portion indicated by reference numeral 3 in FIG. 1, FIG. 4 is a cross-sectional view taken along the line 4—4 in FIG. 3, FIG. 5 is an enlarged view of a portion indicated by reference numeral 5 in FIG. 1, FIG. 6 is a drawing corresponding to FIG. 1, which shows an operating state of an inlet valve closing timing delaying device, FIG. 7 is a graph showing changes in valve lift amount caused by inlet valve delayed closing control, and FIG. 8 shows time charts showing changes in valve lift amount, coil voltage and oil current which occur when the inlet valve delayed closing control is carried out.

As shown in FIG. 1, a single overhead-camshaft (SOHC) in-line four-cylinder engine E includes a cylinder block 11, a cylinder head 12 connected to an upper surface of the cylinder block 11 and a camshaft holder 13 connected to an upper surface of the cylinder head 12, and pistons 15 slidably fit in cylinders 14 formed in the cylinder block 11. In the cylinder head 12, two inlet ports 16, 16 and two exhaust ports 17, 17 are formed for each cylinder 14, and combustion chambers 18 formed in a lower surface of the cylinder head so as to confront upper surfaces of the pistons 15, respectively, communicate with the inlet ports 16, 16 and the exhaust ports 17, 17 via inlet valve openings 19, 19, and exhaust valve openings 20, 20, respectively.

Inlet valves 21, 21 which are engine valves for opening and closing the inlet valve openings 19, 19 are slidably guided by valve guides provided in the cylinder head 12 and are biased by inlet valve springs 23, 23 in a direction in which the valves are closed. Exhaust valves 24, 24 which are engine valves for opening and closing the exhaust valve openings 20, 20 are slidably guided by valve guides 25, 25 provided in the cylinder head 12 and are biased by exhaust valve springs 26, 26 in a direction in which the valves are closed. The camshaft holder 13 is a single member which is disposed in a longitudinal direction of the cylinder head 12, and a camshaft 27 which is commonly used for the inlet and exhaust valves is supported between the upper surface of the cylinder head 12 and a lower surface of the camshaft holder 13. The camshaft 27 is connected to a crankshaft via a timing chain and revolves at half the crankshaft speed.

As is clear when also referring to FIG. 2, an inlet rocker arm shaft 28 and an exhaust rocker arm shaft 29 are supported on the camshaft holder 13 above the camshaft 27. A primary inlet rocker arm 30 and a secondary inlet rocker arm 31 are disposed adjacent to each other on the inlet rocker arm shaft 28, whereas primary and secondary exhaust rocker arms 32, 33 are disposed on axially outward sides of the primary and secondary inlet valves 30, 31, respectively.

The primary inlet rocker arm 30 is supported on the inlet rocker arm shaft 28 at an intermediate portion thereof. An adjustor bolt 34 adapted for abutment with a stem end 21*a* of one of the inlet valves 21 and a holding rod receiving member 35 having a spherical upper surface are provided at one end portion of the primary inlet rocker arm 30 which is so bifurcated by the inlet rocker arm shaft 28, whereas a roller 37 adapted for abutment with an inlet high cam 36 provided on the camshaft 27 is supported on the other end portion thereof. The secondary inlet rocker arm 31 is supported on the inlet rocker arm shaft 28 at an intermediate portion thereof, and an adjustor bolt 38 adapted for abutment with a stem end 21*a* of the other inlet valve 21 is provided at one end portion, whereas a slipper 40 adapted for abutment with an inlet low cam 39 provided on the camshaft 27 is provided on the other end portion thereof. In addition, the height of a lobe of the inlet low cam 39 is set lower than that of a lobe of the inlet high cam 36.

A coupling and decoupling mechanism 41 for coupling the primary and secondary inlet rocker arms 30, 31 together for an integrated rocking or decoupling the primary and secondary inlet rocker arms 30, 31 separately for an independent rocking is provided on the primary and secondary inlet rocker arms 30, 31 at the opposite ends thereof to the ends where the roller 37 and the slipper 40 are provided beyond the inlet rocker arm shaft 28.

The coupling and decoupling mechanism 41 includes pin holes 30*a*, 31*a* formed coaxially in the primary and secondary inlet rocker arms 30, 31, a primary pin 42 adapted for slidably fitting in the pin hole 30*a* in the primary inlet rocker arm 30, a secondary pin 43 adapted for slidably fitting in the pin hole 31*a* in the secondary inlet rocker arm 31, a return spring 44 for biasing the primary pin 42 towards the secondary pin 43 and an oil chamber 45 formed in a face of an end of the secondary pin 43 which is opposite to an end thereof which faces the primary pin 42, and the oil chamber 45 normally communicates with an oil passage 28*a* formed in the interior of the inlet rocker arm shaft 28 via oil holes 28*b*, 30*b* which are formed in the inlet rocker arm shaft 28 and the secondary inlet rocker arm 31, respectively.

Consequently, when a command is given from a control device, not shown, to supply a hydraulic pressure to the oil chamber 45 via the oil passage 28*a* in the inlet rocker arm shaft 28, the oil hole 28*b* in the inlet rocker arm shaft 28 and the oil hole 30*b* in the secondary inlet rocker arm 31, the primary and secondary pins 42, 43 move against a spring-back force of the return spring 44. As shown in FIG. 2, the secondary pin 43 straddles both the pin holes 30*a*, 31*a*, whereby the primary and secondary inlet rocker arms 30, 31 are coupled together so as to rock together. In contrast, when the hydraulic pressure so supplied to the oil chamber 45 is vented, the primary and secondary pins 42, 43 are pushed back by virtue of the spring-back force of the return spring 44. The primary and secondary pins 42, 43 so pushed back are then accommodated in the pin holes 30*a*, 31*a* in the primary and secondary inlet rocker arms 30, 31, respectively, whereby the primary and secondary inlet rocker arms 30, 31 are decoupled separately so as to rock independently.

Rollers 46, 47 provided at one ends of the primary and secondary exhaust rocker arms 32, 33 which are rockingly supported on the exhaust rocker arm shaft 29 abut with exhaust cams 48, 49 provided on the camshaft 27, and adjustor bolts 50, 51 provided at the other ends of the primary and secondary exhaust rocker arms 32, 33 abut with stem ends 24*a*, 24*a* of the exhaust valves 24, 24. In addition, reference numeral 52 denotes a sparking plug inserting tube, which is provided between the pair of exhaust valves 24, 24.

Next, the construction of an inlet valve closing timing delaying device 61 for delaying a valve closing timing of the inlet valves 21, 21 will be described.

The inlet valve closing timing delaying device 61 is such as to be provided on the camshaft holder 13 and, being made to correspond to each of the four cylinders 14 . . . , has an electromagnetic actuator mechanism 62, a hydraulic damper mechanism 63 and armature fixing mechanisms 64. The electromagnetic actuator mechanisms 62 which are provided to correspond to the respective cylinders 14 are all identical to one another in construction, this holding the same with the remaining hydraulic damper mechanisms 63 and armature fixing mechanisms 64. Therefore, with each of the electromagnetic actuator mechanism 62, the hydraulic damper mechanism 63 and the armature fixing mechanism 64, one of the four identical mechanisms is taken for description of the construction thereof, respectively.

As is clear from FIGS. 3 and 4, the electromagnetic actuator mechanism 62 has a primary end plate 65, a secondary end plate 66, and two yokes 70, 70 which are made up of a number of primary stacked plates 68 . . . and a number of secondary stacked plates 69 . . . , respectively. The primary stacked plates 68 . . . and the secondary stacked plates 69 . . . of the yokes 70, 70 are transversely symmetrical in shape with each other and have coil accommodating grooves 68*a*, 69*a* which are made to open in upper surfaces thereof, respectively. In addition, the primary end plate 65 and the secondary end plate 66 have coil accommodating grooves 65*b*, 65*c*; 66*b*, 66*c* which communicate with the coil accommodating grooves 68*a*, 69*a* of the primary and secondary stacked plates 68 . . . , 69 . . . . A coil 71 wound around a bobbin is allowed to fit in the coil accommodating grooves 68*a*, 69*a* of the primary and secondary stacked plates 68, 69 and the coil accommodating grooves 65*b*, 65*c*; 66*b*, 66*c* of the primary and secondary end plates 65, 66 from above. Furthermore, a rare short plate 72 having substantially the same configuration as that of the coil 71 is disposed on an upper portion of the coil 71 so fitted. While the rare short plate 72 is made up of a solid material fabricated by blanking, forging or skiving, in the event that the rare short plate 72 is made up of stacked plates, the effect thereof can be enhanced further.

The rare short plate 72, which is formed into substantially a rectangular frame-like configuration, is divided by a slit 72*a* formed in part thereof, and is fixed such that an upper surface of the rare short plate 72 is made flush with the upper surfaces of the primary and secondary end plates 65, 66 and the upper surfaces of the primary and secondary stacked plates 68 . . . , 69 . . . . The coil 71 fits in the coil accommodating grooves 65*b*, 65*c*; 66*b*, 66*c*; 68*a*; 69*a* fixedly secured in place with resin, and the rare short plate 72 is also fixedly secured in place together with the coil 71 with the resin. A holding rod 74 having an armature 73 provided at an upper end thereof is slidably supported between the left and right yokes 70, 70. The armature 73 which is formed into substantially a rectangular shape confronts the upper surfaces of the primary and secondary end plates 65, 66 and the primary and secondary stacked plates 68 . . . , 69 . . . on a lower surface thereof.

A pair of upper and lower fastening bolts 75 . . . are disposed to extend through outward sides of the respective yokes, and when the four fastening bolts 75 . . . so disposed penetrate through the end plates, the primary and secondary end plates 65, 66 and the primary and secondary stacked plates 68 . . . , 69 . . . are fastened together. Upper outward side portions or portions situated above the fastening shafts 75 . . . of the primary and secondary stacked plates 68 . . . , 69 . . . are cut out to form cut-out portions 68*b*, 69*b*, respectively.

As is clear from FIG. 1, a sensor 89 is supported on the camshaft holder 13 via a stay 88, and the vertical position of the armature 73 is detected by this sensor 89.

Next, the construction of the hydraulic damper mechanism 63 will be described based upon FIGS. 1 and 5 which hydraulic damper mechanism is adapted for absorbing an impact generated by the inlet valves 21, 21 when the inlet valves 21, 21 are released from being held open by the electromagnetic mechanism 62 and are then closed.

The hydraulic damper mechanism 63 is such as to be accommodated in the interior of a thick portion on the upper surface of the camshaft holder 13 and includes a cylinder 91 formed in the camshaft holder 13 in such manner as to open in a lower surface thereof, a cup-like piston 92 which slidably fits in the cylinder 91 and an oil chamber 93 defined by the cylinder 91 and the piston 92, whereby the holding rod 74 of the electromagnetic actuator mechanism 62 is allowed to extend through the piston 92 to be fixed in place. A plurality of orifices 94 . . . are formed in an inner wall surface of the cylinder 91, and a plurality of orifices 92*a* . . . are formed in the piston 92 in such a manner as to extend therethrough. Oil is supplied from an oil supply into the oil chamber 93 formed above the piston 92 via a check valve (not shown) and the oil which is then discharged from the oil chamber 93 through the orifices 94 . . . is returned to an oil tank via a check valve (not shown).

In an area above the oil chamber 93, a holding rod passage hole 95 surrounding an outer circumference of the holding rod 74 extends up to the upper surface of the camshaft holder 13. A vent space is formed between the holding rod passage hole 95 and the holding rod 74. Consequently, in filling oil into the oil chamber 95 and an oil passage which communicates with the oil chamber 95 before the electromagnetic actuator mechanism 62 is fastened to the camshaft holder 13, venting can be implemented via the holding rod passage hole 95, and hence the necessity of a special vent hole for this purpose can be obviated.

Next, the construction of the armature fixing mechanisms 64, 64 will be described based upon FIGS. 1 and 5 which armature fixing mechanisms are adapted for holding the armature 73 at a lifted position, when the electromagnetic actuator mechanism 62 is not in operation.

A pair of armature fixing mechanisms 64, 64 are disposed in the interior of the thick portion on the upper surface of the camshaft holder 13 for each cylinder 14 in such a manner as to hold the hydraulic damper mechanism 63 therebetween. Each armature fixing mechanism 64 contains a cylinder 96 formed in the camshaft holder 13, a piston 97 which slidably fits in the cylinder 96, a return spring 98 for biasing the piston 97 upwardly, an oil chamber 99 formed in an upper surface of the piston 97 and an armature locking member 100 which protrudes upwardly from the upper surface of the piston 97 for abutment with a lower surface of a projection 73*a* from the armature 73. The armature locking member 100 extends through the camshaft holder 13 to protrude upwardly therefrom (refer to FIG. 6).

When the inlet valve closing timing delaying device 61 is not in operation, hydraulic pressures in the oil chambers 99 of the armature fixing mechanisms 64, 64 are gone, as shown in FIGS. 1 and 5. Hence the armature locking members 100, 100 are lifted by virtue of the spring-back forces of the return springs 98, 98 to thereby hold the projections 73*a*, 73*a* of the armatures 73, 73 at pushed-up positions, whereby the holding rod 74 is prevented from unnecessarily fluctuating together with the armature 73, which would otherwise occur as the primary inlet rocker arm 30 rocks.

By this construction, the interruption of smooth rocking of the primary inlet rocker arm 30 by inertia weights and sliding resistances of the holding rod 74 and the armature 73 can be prevented. In addition, during a high-speed operation of the engine E in which the fluctuating movement of the holding rod 74 cannot follow the rocking movement of the primary inlet rocker arm 30, a lower end of the holding rod 74 is prevented from separating from and colliding against the holding rod receiving member 35 of the primary inlet rocker arm 30 which would otherwise trigger the generation of noise and the reduction in durability thereof.

On the other hand, when the inlet valve closing timing delaying device 61 is in operation, hydraulic pressures are supplied to the oil chambers 99, 99 of the armature fixing mechanisms 64, 64, as shown in FIG. 6. Hence the armature locking members 100, 100 are lowered against the spring-back forces of the return springs 98, 98. As a result, the armature locking members 100, 100 are moved downwardly away from the armature 73, whereby the armature 73 and the holding rod 74 are allowed to be in a state in which they are lifted up and down freely.

Since the pair of projections 73*a*, 73*a* of the armature 73 are fixed in place by the armature locking members 100, 100 of the pair of armature fixing mechanisms 64, 64 which are disposed symmetrically with each other across the holding rod 74 which is held therebetween. The inclination of the armature 73 and the gouging of the holding rod 74 can be prevented in an ensured fashion.

Next, the function of the embodiment which is constructed as has been described heretofore will be described.

In FIG. 2, when the hydraulic pressure in the oil chamber 45 of the coupling and decoupling mechanism 41 provided on the valve trains of the inlet valves 21, 21 is released in a low-speed operating area of the engine E. The primary and secondary pins 42, 43 are pushed back by virtue of the spring-back force of the return spring. The primary and secondary pins 42, 43 are received in the pin holes 30*a*, 31*a* of the primary and secondary inlet rocker arms 30, 31, respectively, whereby the primary and secondary inlet rocker arms 30, 31 are separated from each other so that the primary and secondary inlet rocker arms 30, 31 can rock independently. As a result, the primary inlet rocker arm 30 whose roller 37 is in abutment with the inlet high cam 36 whose lobe is higher rocks largely so as to open and close one of the inlet valves 21, 21 in a large lift amount. Whereas the secondary inlet rocker arm 31 whose slipper 40 is in abutment with the inlet low cam 39 whose lobe is lower rocks slightly so as to open and close the other inlet valve 21 in a small lift amount. Whereby a swirl of charge is generated within the combustion chamber 18 to thereby enhance the combustion efficiency of air-fuel mixture.

When a hydraulic pressure is supplied to the oil chamber 45 of the coupling and decoupling mechanism 41 in middle- and high-speed operating areas of the engine E, the primary and secondary pins 42, 43 move against the spring-back force of the return spring 44, as shown in FIG. 2. The secondary pin 43 straddles both the pin holes 30*a*, 31*a*, whereby the primary and secondary inlet rocker arms 30, 31 are coupled together so that the primary and secondary inlet rocker arms 30, 31 can rock together. As a result, the secondary inlet rocker arm 31 rocks largely together with the primary inlet rocker arm 30 in which the roller 37 abuts with the inlet high cam 36 whose lobe is higher so as to open and close both the inlet valves 21, 21 in a large lift amount to thereby enhance the output of the engine E.

When the inlet valve closing timing delaying device 61 is not in operation, or when the coil 71 of the electromagnetic actuator mechanism 62 is not energized, the hydraulic pressures in the oil chambers 99, 99 of the armature fixing mechanisms 64, 64 are gone, as shown in FIG. 1. Hence the armature locking members 100, 100 are lifted up by virtue of the spring-back force of the return springs 98, 98 and are then brought into engagement with the projections 73*a*, 73*a* to thereby hold the armature 73 at the pushed-up position. As a result, the holding rod 74 is prevented from unnecessarily fluctuating together with the armature 73 in association with the rocking movement of the primary inlet rocker arm 30.

By this construction, the interruption of smooth rocking of the primary inlet rocker arm 30 by the inertia weights and sliding resistances of the holding rod 74 and the armature 73 can be prevented, whereby the inlet valve 21 is allowed to open and close smoothly. In particular, during a high-speed operation of the engine E, the fluctuating movement of the holding rod 74 cannot follow the rocking movement of the primary inlet rocker arm 30, whereby there is caused a situation in which the lower end of the holding rod 74 separates from and collides against the holding rod receiving member 35 of the primary inlet rocker arm 30, which may possibly cause the generation of noise and the reduction in durability. However, in the event that the armature locking members 100, 100 are lifted by the spring-back force of the return springs 98, 98 to thereby hold the armature 73 at a lifted position during the high-speed operation of the engine E, the generation of noise and the reduction in durability can securely be prevented.

On the other hand, when the inlet valve closing timing delaying device 61 is in operation, or when the coil 71 of the electromagnetic actuator mechanism 62 is energized, hydraulic pressures are supplied to the oil chambers 99, 99 of the armature fixing mechanisms 64, 64, as shown in FIG. 6. The armature locking members 100, 100 are lowered against the spring-back force of the return springs 98, 98. As a result, the armature locking members 100, 100 are moved downwardly away from the projections 73*a*, 73*a* of the armature 73, whereby the armature 73 and the holding rod 74 are allowed to be in the state in which they can be lifted up and down freely.

Thus, when the coil 71 of the electromagnetic actuator mechanism 62 is magnetized at a timing when the primary inlet rocker arm 30 pushes down the stem end 21*a* of the inlet valve 21 so as to maximize the lift amount of the inlet valve 21. The armature 73 is attracted to the yokes 70, 70, which then lowers the holding rod 74, and the lower end of the holding rod 74 eventually pushes the holding rod receiving member 35 downwardly. Then, the primary inlet rocker arm 30 rocks, and then the adjustor bolt 34 provided at one end of the primary inlet rocker arm 30 pushes against the stem end 21*a* of the inlet valve 21, whereby the inlet valve 21 is held open. As this occurs, the roller 37 provided at the other end of the primary inlet rocker arm 30 moves apart from the inlet high cam 36 on the camshaft 27 and revolves idly.

When the coil 71 is demagnetized after a predetermined length of time has elapsed, the inlet valve 21 is lifted up to the closing position by virtue of the spring-back force of the inlet valve spring 23. The primary inlet rocker arm 30 rocks in an opposite direction, whereby the roller 37 is brought into abutment with the inlet high cam 36. The armature 73 is lifted up together with the holding rod 74 which is lifted up at the lower end thereof by the holding rod receiving member 35 to thereby move apart from the upper surfaces of the yokes 70, 70. Thus, by magnetizing and demagnetizing the coil 71 of the electromagnetic actuator mechanism 62 at the predetermined timings, the closed period of the inlet valve 21 can arbitrarily be delayed. Thereby making it possible to attempt to reduce the fuel consumption by reducing the pumping loss. FIG. 7 shows changes in valve lift amount occurring at 650 rpm and 3000 rpm by such a delayed closing control of the inlet valve 21.

Note that in the event that the primary and secondary inlet rocker arms 30, 31 are coupled together by the coupling and decoupling mechanism 41 when the electromagnetic actuator mechanism 62 is in operation, the valve closing timings of the two inlet valves 21, 21 can be delayed together. In addition, in the event that the primary and secondary inlet rocker arms 30, 31 are not coupled together by the coupling and decoupling mechanism 41 or are decoupled from each other, only the valve closing timing of the inlet valve 21 situated on the primary inlet rocker arm 30 is delayed, and the inlet valve 21 situated on the secondary inlet rocker arm 31 is caused to open and close in a valve lift amount according to the profile of the inlet low cam 39.

Thus, while the valve functions of the inlet valves 21, 21 have been described heretofore, the valve functions of the exhaust valves 24, 24 are similar to those of conventional ones. Namely, in FIG. 2, the primary and secondary exhaust rocker arms 32, 33 whose rollers 46, 47 are in abutment with the exhaust cams 48, 49 provided on the camshaft 27, respectively, are caused to rock about the exhaust rocker arm shaft 29. Whereby the exhaust valves 24, 24 whose stem ends 24*a*, 24*a* are in abutment with the adjustor bolts 50, 51 provided on the primary and secondary exhaust valves 32, 33, respectively, are driven to open and close.

As is clear from FIG. 3, since the four fastening shafts 75 . . . which connect together the primary and secondary stacked plates 68 . . . , 69 . . . and the primary and secondary end plates 65, 66 of the yokes 70, 70 are disposed at the side positions which are located so as to avoid magnetic paths C, C formed in the yokes 70, 70. The reduction in magnetic flux density which is attributed to the fastening shafts 75 . . . can be suppressed to a minimum level, and moreover, since the fastening shafts 75 . . . are disposed sideways of the magnetic paths C, C, the vertical dimension of the electromagnetic actuator mechanism 62 can be reduced. In addition, since the cut-out portions 68*b*, 69*b* are formed at the outward side positions or positions above the fastening shafts 75 . . . of the primary and secondary stacked plates 68 . . . , 69 . . . on the upper surfaces of the yokes 70, 70 to which the armature 73 is attracted to adhere, the amount of magnetic flux which passes through the fastening shafts 75 . . . can be reduced to thereby make smaller the reduction in magnetic flux density attributed to the fastening shafts 75 . . . . In addition, since the primary and secondary stacked plates 68 . . . , 69 . . . are fixed to the camshaft holder 13 on lower surface sides thereof where no cut-out portions such as the cut-out portions 68*b*, 69*b* are formed. A fixing area can be secured so sufficiently that the fixing strength of the electromagnetic actuator mechanism 62 to the camshaft holder 13 can be enhanced.

Furthermore, since the height of the cut-out portions 68*b*, 69*b* measured in a direction in which the armature 73 travels is larger than a gap produced between the armature 73 and the yokes 70, 70 when the armature 73 is attracted to adhere to the attracting surfaces of the yokes 70, 70, the amount of magnetic flux which passes through the attracting surfaces of the yokes 70, 70 when the armature 73 is attracted to adhere thereto can be secured to a maximum level to thereby enhance the force with which the armature 73 is attracted. Moreover, since the two fastening shafts 75, 75 which are provided on the outward side of the yoke 70 are disposed apart from each other in the vertical direction, the primary and secondary stacked plates 68 . . . , 69 . . . are fastened together so strongly to prevent the occurrence of opening (loose fastening) in the attracting surfaces of the yokes 70, 70, thereby making it possible to suppress the reduction in the force with which the armature 73 is attracted.

Incidentally, since the electromagnetic actuator mechanism 62 holds the inlet valve 21 in the open state against the strong spring-back force of the valve spring 23, the electromagnetic actuator mechanism 62 needs to attract the armature 73 with a large attraction force. In addition, also in order to suppress the loss at a driving circuit of the electromagnetic actuator mechanism 62 to a minimum level, the electromagnetic actuator mechanism 62 has desirably a higher driving voltage. To this end, in a conventional electromagnetic actuator mechanism 62, it is premised that the voltage of the onboard battery, which is 12V, is increased to actuate the mechanism. The reason why it is difficult to drive the electromagnetic actuator mechanism 62 at a lower voltage (in other words, at 12V which is the voltage of an onboard battery) will be described below.

In order to operate an electromagnetic actuator mechanism 62 which is designed to operate appropriately at a certain voltage (for example, at 42V) at a lower voltage, a voltage application time to the coil 71 needs to be longer than that employed in a case where a higher voltage is used to thereby promote a growth of magnetic flux in the yokes 70, 70. However, in a case where the engine E speed is high, since there can be no enough time to wait for such a growth of magnetic flux, it gets difficult to attract the armature 73 for adhesion with good response at an appropriate timing. In addition, in the event that the voltage is applied at an earlier timing so as to extend the voltage application time to the coil 71, since a distance between the armature 73 and the yokes 70, 70 at the point in time where the voltage is started to be applied is long. An equivalent inductance which is expected to be induced from an electric terminal of the electromagnetic actuator mechanism 62 becomes very small, and a large current flows, although the voltage is low. As a result, losses at the direct resistance of the coil 71 and the driving elements in the driving circuit of the electromagnetic actuator mechanism 62 become large, and sufficient contributions to the growth of magnetic flux cannot be attained. In order to obtain a desired magnetic flux, the voltage application timing to the coil 71 needs to be made much earlier, this leading to a situation in which the power consumption of the electromagnetic actuator mechanism 62 increases excessively or in which the armature 73 cannot be attracted.

In the present invention, however, since the rare short plate 72 is disposed on the upper surface of the coil 71 which fits in the coil accommodating grooves 65*b*, 65*c*; 66*b*, 66*c*; 68*a*; 69*a* formed, respectively, in the primary and secondary stacked plates 68 . . . , 69 . . . which constitute the yokes 70, 70 of the electromagnetic actuator mechanism 62 and the primary end plates 65, 66. The coil accommodating grooves 65*b*, 65*c*; 66*b*, 66*c*; 68*a*; 69*a* are magnetically rare short-circuited so as to promote the growth of magnetic flux in the yokes 70, 70 after the voltage has been applied to the coil 71. As a result, a sufficient magnetic flux can quickly be generated in the yokes 70, 70 so as to attract the armature 73 at an appropriate timing without increasing the voltage of the onboard battery which is 12V and making the voltage application to the coil 71 so earlier. Whereby the delayed closing control of the inlet valve 12 can be implemented even when the engine E speed is high.

In addition, since the upper surface of the rare short plate 72 is made flush with the upper surfaces of the primary and secondary endplates 65, 66 and the primary and secondary stacked plates 68 . . . , 69 . . . . The upper surface of the rare short plate 72 can be made to function as part of the attracting surface to which the armature 73 is attracted. This enables the armature 73 which is attracted to adhere to the yokes 70, 70 to be integrated into the rare short plate 72 to thereby substantially increase the magnetic path area of the armature, the magnetic saturation being thereby relaxed. Consequently, although it may be limited, the armature 73 can be attempted to be made thinner to reduce the weight thereof, and the vertical dimension of the electromagnetic actuator mechanism 62 can be reduced. Moreover, since the position of the rare short plate 72 is raised, the volumes of the coil accommodating grooves 65*b*, 65*c*; 66*b*, 66*c*; 68*a*; 69*a* which are formed underneath the rare short plate 72 can be increased to thereby enlarge the size of the coil 71 accordingly.

Additionally, a gap $\alpha$ between the rare short plate 72 and the coil accommodating grooves 65*b*, 65*c*; 66*b*, 66*c*; 68*a*; 69*a* (refer to FIGS. 3 and 4) is larger than the gap (substantially zero) between the armature 73 and the attracting surfaces of the yokes 70, 70 when the armature 73 is attracted to adhere thereto. A leakage of magnetic flux to the gap $\alpha$ can be prevented to thereby increase the force with which the armature 73 is attracted. Furthermore, since the slit 72*a* is formed in part of the rectangular rare short plate 72, an eddy current is refrained from flowing through the rare short plate 72, which would otherwise occur due to induced electromotive force attributed to magnetic flux generated in the yokes 70, 70, and the consumed power of the coil 71 can be reduced.

As is clear from a comparison between an electromagnetic actuator mechanism having no rare short plate 72 (refer to FIG. 8A) and an electromagnetic actuator mechanism having a rare short plate 72 (refer to FIG. 8B), the valve lift amount of the inlet valve 21 can be held at the maximum valve lift position by provision of the rare short plate 72 even if the voltage application timing is delayed and current supplied. Energy introduced to the coil 71 until the armature 73 is attracted for adhesion are reduced largely.

Then, when the coil 71 is shifted from the magnetized state to the demagnetized state in order to release the inlet valve 21 from being held open, the inlet valve 21 is caused to close by virtue of the spring-back force of the inlet valve spring 23. As this occurs, the hydraulic damper 63 is activated to function to prevent the inlet valve 21 from being seated into the inlet valve hole 19 with an impact. Namely, when the holding rod 74 is pushed up by the stem end 21*a* of the closing inlet valve 21, the piston 92 of the hydraulic damper mechanism 63 which is pushed by the holding rod 74 is pushed up from a lowered position in FIG. 6 to the lifted position in FIG. 1. When the piston 92 is raised within the cylinder 91, the volume of the oil chamber 93 above the piston 92 is reduced. Although a hydraulic pressure is supplied to the oil chamber 93 via an entrance side check valve which is opened while the piston 92 stays at the lowered position, when the volume of the oil chamber 93 decreases as the piston 92 rises, the entrance side check valve closes, and oil within the oil chamber 93 is discharged by opening an exhaust side check valve. As this occurs, the oil within the oil chamber 93 passes through the orifices 94 . . . in the wall surface of the cylinder 91 and the orifices 92*a* . . . in the piston 92, whereby a hydraulic damping or shock absorbing force is generated which prevents the inlet valve 12 from being seated into the inlet valve hole 19 with an impact.

The generating mechanism of hydraulic damping force will be described in greater detail below. When the piston 92 rises from the lowered position shown in FIG. 6, passage of oil through the orifices 94 . . . in the wall surface of the cylinder 91 generates a hydraulic damping force, and the valve lift amount is reduced by a certain ratio. When an upper end of the piston 92 closes the orifices 94 . . . in the wall surface of the cylinder 91 as the piston 92 moves upwardly, passage of oil through the orifices 92*a* . . . in the piston which have smaller diameters, which occurs thereafter, generates a stronger hydraulic damping force. The reduction ratio of the valve lift amount is lowered, whereby the inlet valve 21 is allowed to be seated slowly without generating any impact.

Thus, since the hydraulic damper mechanism 63 and the armature fixing mechanisms 64, 64 are provided in the interior of the camshaft holder 13, not only can the height-wise dimension of the engine E be reduced but also the necessity of special supporting members for supporting those mechanisms can be obviated to thereby reduce the number of components involved. In addition, the working of the cylinder head 12 can be facilitated by forming oil passages communicating with the hydraulic damping mechanism 63 and the armature fixing mechanisms 64, 64 in the camshaft holder 13. Furthermore, when compared with the case where the hydraulic damper mechanism 63 and the armature fixing mechanisms 64, 64 are mounted on the head cover, the fixing rigidity can be enhanced and the height-wise dimension of the engine E can be reduced. Additionally, when compared with the case where those mechanisms are mounted on the cylinder head, the cylinder head 12 can be made smaller in size. In particular, since the hydraulic damper mechanisms 63 are provided at the highly rigid connecting portions of the integrated camshaft holder (namely, portions connecting journal supporting portions where the journals of the camshaft 27 are supported), the fixing rigidity of the hydraulic damper 63 can be enhanced.

Thus, while the embodiment of the present invention has been described in detail heretofore, the present invention can be modified in various ways without departing from the spirit and scope of the present invention.

For example, the present invention can be applied to boat-propelling marine engines such as outboard engines in which a crankshaft is disposed vertically.

Thus, according to the first aspect of the present invention, because the hydraulic damper mechanism adapted for absorbing the impact generated by the inlet valve when the inlet valve is released from being held by the electromagnetic actuator mechanism so as to be restored to a closed state and is then seated is supported on the camshaft holder, not only is the necessity of a special support member obviated to thereby reduce the number of components involved but also oil passages which communicate with the hydraulic damper mechanisms can be formed in the camshaft holder to thereby facilitate the working of the cylinder head. In addition, when compared with the case where the hydraulic damper mechanisms are mounted on the head cover, the fixing rigidity can be enhanced, and the dimension of the engine in the height direction can be reduced. Furthermore, when compared with the case where the hydraulic damper mechanisms are mounted on the cylinder head, the cylinder head can be made smaller in size.

In addition, according to the second aspect of the present invention, since the hydraulic damper mechanism is provided at the connecting portion of the integrated camshaft holder which is connected together in the direction in which the plurality of cylinders are arranged. The hydraulic damper mechanism is allowed to be mounted on the portion of the camshaft holder which has a high rigidity to thereby enhance the fixing rigidity.

Additionally, according to the third aspect of the present invention, since the hydraulic damper mechanism is accommodated in the interior of the camshaft holder in such a manner as to be situated below the electromagnetic actuator mechanism, not only can the dimension of the engine in the height direction be reduced but also the fixing rigidity of the hydraulic damper mechanism can be enhanced further.

In addition, according to the fourth aspect of the present invention, since the holding rod passage hole which is provided in the hydraulic damper mechanism so as to allow the holding rod of the electromagnetic actuator mechanism to pass therethrough functions as a vent hole for venting air from the oil chamber of the hydraulic damper mechanism. Air in the oil chamber can be vented without providing any special vent hole for that purpose.

What is claimed is:

1. An engine valve train comprising:

a camshaft supported on a camshaft holder and driving inlet valves to open and close via inlet rocker arms;

an electromagnetic actuator mechanism including an armature;

a holding rod connected to the armature and pressing against a stem end of the inlet valve so as to hold the inlet valve in an open state; and, a hydraulic damper mechanism absorbing an impact which is generated by the inlet valve via the holding rod when the inlet valve is released from being held by the electromagnetic actuator mechanism so as to be restored to a closed state and is then seated, wherein the hydraulic damper mechanism is supported on the camshaft holder.

2. The engine valve train as set forth in claim 1, wherein the camshaft holder is an integrated body connected together in a direction in which a plurality of cylinders are arranged, and wherein the hydraulic damper mechanism is provided at a connecting portion of the camshaft holder.

3. The engine valve train as set forth in claim 1, wherein the hydraulic damper mechanism is provided coaxially with and below the electromagnetic actuator mechanism, and wherein the hydraulic damper mechanism is accommodated in the interior of the camshaft holder.

4. The engine valve train as set forth in claim 2, wherein the hydraulic damper mechanism is provided coaxially with and below the electromagnetic actuator mechanism, and wherein the hydraulic damper mechanism is accommodated in the interior of the camshaft holder.

5. The engine valve train as set forth in claim 3, wherein the hydraulic damper mechanism is provided with a holding rod passage hole through which the holding rod of the electromagnetic actuator mechanism is allowed to pass, the holding rod passage hole also functioning as a vent hole for venting air from an oil chamber of the hydraulic damper mechanism.

6. The engine valve train as set forth in claim 4, wherein the hydraulic damper mechanism is provided with a holding rod passage hole through which the holding rod of the electromagnetic actuator mechanism is allowed to pass, the holding rod passage hole also functioning as a vent hole for venting air from an oil chamber of the hydraulic damper mechanism.

7. The engine valve train as set forth in claim 1 further comprising: a pair of armature fixing mechanisms disposed in the interior of the camshaft holder so as to hold the hydraulic damper mechanism.

8. The engine valve train as set forth in claim 7, wherein each armature fixing mechanism includes a cylinder formed in the camshaft holder, a piston which slidably fits in the cylinder, a return spring for biasing the piston upwardly, an oil chamber formed in an upper surface of the piston and an armature locking member which protrudes upwardly from the upper surface of the piston for abutment with a lower surface of a projection from the armature.

* * * * *